US009016524B2

(12) United States Patent
Chisholm

(10) Patent No.: US 9,016,524 B2
(45) Date of Patent: Apr. 28, 2015

(54) TAMPER-EVIDENT ANTI-REFILL DISPENSING FITMENT FOR A CONTAINER

(71) Applicant: Owens-Brockway Glass Container Inc., Perrysburg, OH (US)

(72) Inventor: Brian J Chisholm, Sylvania, OH (US)

( * ) Notice: Subject to any disclaimer, the term of this patent is extended or adjusted under 35 U.S.C. 154(b) by 39 days.

(21) Appl. No.: 13/621,603

(22) Filed: Sep. 17, 2012

(65) Prior Publication Data

US 2014/0076933 A1 Mar. 20, 2014

(51) Int. Cl.
*B65D 47/02* (2006.01)
*B65D 49/02* (2006.01)
*B65D 55/02* (2006.01)

(52) U.S. Cl.
CPC ..... *B65D 49/02* (2013.01); *B65D 55/026* (2013.01); *B65D 2101/00* (2013.01)

(58) Field of Classification Search
CPC ..... B56D 49/00; B56D 17/50; B56D 49/02; B56D 55/026; B56D 2101/00
USPC ..... 222/147, 153.09, 153.1, 454–457; 215/14–30, 232, 250, 258, 299; 220/258.3, 258.5, 255.1
See application file for complete search history.

(56) References Cited

U.S. PATENT DOCUMENTS

| | | | | |
|---|---|---|---|---|
| 520,219 | A | 5/1894 | Rand et al. | |
| 562,637 | A | 6/1896 | Meyer | |
| 572,329 | A | 12/1896 | Bullard | |
| 599,156 | A * | 2/1898 | Thompson | 215/258 |
| 602,044 | A | 4/1898 | Grapes | |
| 641,108 | A | 1/1900 | Hemstreet | |
| 759,496 | A | 5/1904 | Baker et al. | |
| 789,757 | A * | 5/1905 | Prouty | 215/26 |
| 818,312 | A * | 4/1906 | Sullivan et al. | 215/26 |
| 824,838 | A | 7/1906 | Atkinson | |
| 836,852 | A * | 11/1906 | Ambrose | 215/21 |
| 956,750 | A | 5/1910 | Arsac | |
| 3,129,854 | A * | 4/1964 | Boehm et al. | 222/321.9 |
| 3,399,811 | A | 9/1968 | Miller | |
| 6,454,126 | B1 | 9/2002 | Battegazzore | |
| 6,543,648 | B2 * | 4/2003 | de Pous et al. | 222/153.09 |
| 7,011,236 | B2 * | 3/2006 | VanBrocklin | 222/321.9 |
| 7,694,851 | B2 * | 4/2010 | Lompech et al. | 222/23 |
| 8,544,690 | B2 * | 10/2013 | Garcia et al. | 222/147 |

FOREIGN PATENT DOCUMENTS

| | | |
|---|---|---|
| CH | 104293 | 4/1924 |
| DE | 70448 | 8/1893 |
| FR | 329565 | 8/1903 |
| FR | 480460 | 8/1916 |
| GB | 25299 | 0/1911 |
| WO | 2004067387 | 8/2004 |

OTHER PUBLICATIONS

PCT Search Report and Written Opinion, Int. Serial No. PCT/US2013/057229, Int. Filing Date: Aug. 29, 2013 Applicant: Owens-Brockway Glass Container Inc., Mailing Date: Nov. 18, 2013.

* cited by examiner

*Primary Examiner* — Lien Ngo

(57) ABSTRACT

An anti-refill product includes a container including a neck with a neck finish, a fitment received in the neck, and a radially expandable element detachably coupled to the fitment. The radially expandable element is disposed to engage a detent in the neck and detach from the fitment when the fitment is removed from the neck, such that the radially expandable element falls into the body and expands, preventing removal into and through the neck.

17 Claims, 5 Drawing Sheets

TAMPER-EVIDENT ANTI-REFILL DISPENSING FITMENT FOR A CONTAINER

The present disclosure is directed to containers and, more particularly, to non-refillable containers and fitments therefor.

BACKGROUND AND SUMMARY OF THE DISCLOSURE

A container for carrying a liquid product can include a fitment that renders the container non-refillable so as to impede or prevent efforts to refill the container with inferior products. U.S. Pat. No. 3,399,811 illustrates a container of this type.

A general object of the present disclosure, in accordance with one aspect of the disclosure, is to provide a product including a container and a non-refillable fitment coupled to the container and to evidence efforts to tamper with the product via detachment of a portion of the fitment.

The present disclosure embodies a number of aspects that can be implemented separately from or in combination with each other.

An anti-refill product in accordance with one aspect of the disclosure includes a container including a base, a body extending in a direction axially away from the base, a shoulder extending in a direction axially away from the body, and a neck extending in a direction axially away from the shoulder and including a neck finish, an interior surface, and a detent. The product also includes an anti-refill dispensing fitment positioned in the neck of the container, and including a detachable portion having a radially expandable element and a detent engagement element to engage the container detent. If the fitment is displaced in an axial direction away from the container base, then the detent engagement element engages the detent such that continued displacement of the fitment away from the base results in detachment of the detachable portion such that the detachable portion falls into the container body and thereby renders the product tamper-evident.

In accordance with another aspect of the disclosure, there is provided a method of producing a product that includes (a) flowing liquid into a container including a base, a body extending in a direction axially away from the base, and a neck extending in a direction axially away from the body and including a neck finish, an interior surface, and a detent; and (b) assembling an anti-refill fitment into the neck of the container so that a detent engagement element of a detachable portion of the fitment snaps past and engages the container detent and so that a radially expandable element of the fitment is located within the container neck.

In accordance with a further aspect of the disclosure, there is provided a package that includes a bottle having a body and a neck with an open end, a closure coupled to the open end of the neck, and a fitment configured to be received into the open end of the neck. A radially expandable element is detachably coupled to the fitment and disposed to engage a detent in the neck and detach from the fitment when the fitment is removed from the neck, such that the radially expandable element falls into the body and expands, preventing removal into and through the neck.

In accordance with an additional aspect of the disclosure, there is provided a tamper-evident component for an anti-refill dispensing fitment to render a container tamper-evident. The component includes a coupling, a radially expandable element extending radially from the coupling, and a container detent engagement element extending axially and radially from the coupling.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
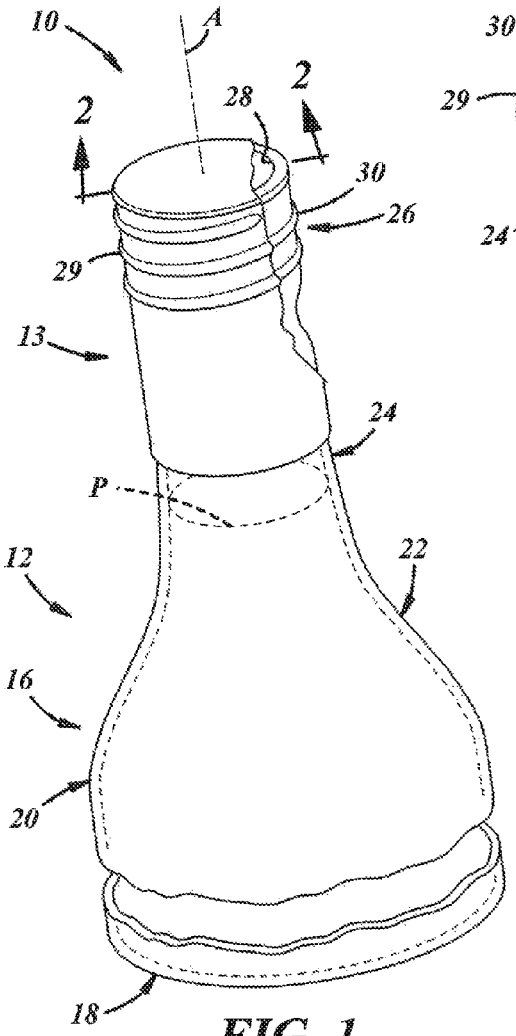
FIG. 1 is a fragmentary, perspective view of a product in accordance with an illustrative embodiment of the present disclosure and including a container and a closure coupled to the container.
Figure 2:
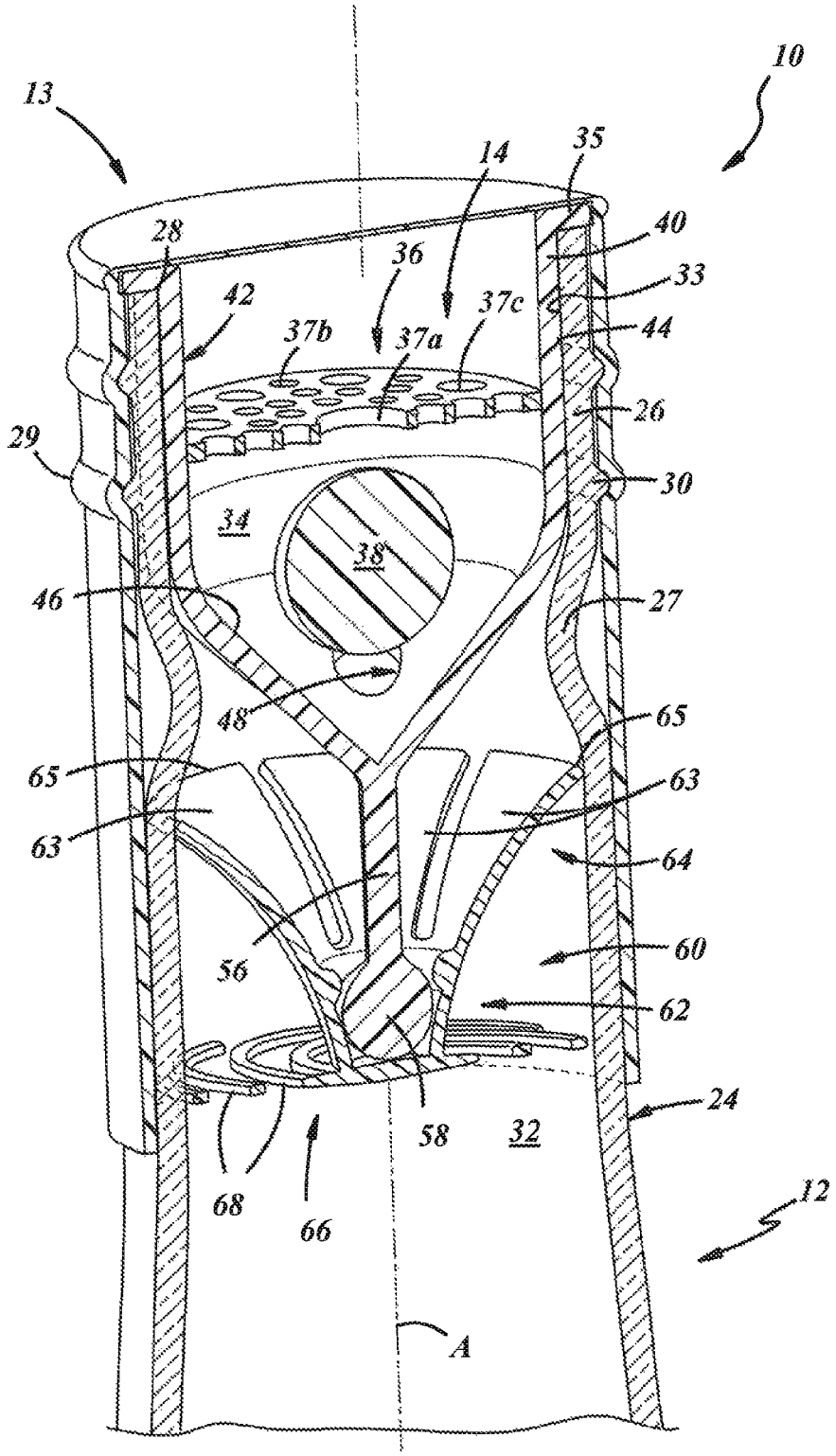
FIG. 2 is an enlarged, fragmentary, cross-sectional view of the product of FIG. 1 including a fitment coupled to the container in accordance with an illustrative embodiment of the present disclosure.
Figure 4:
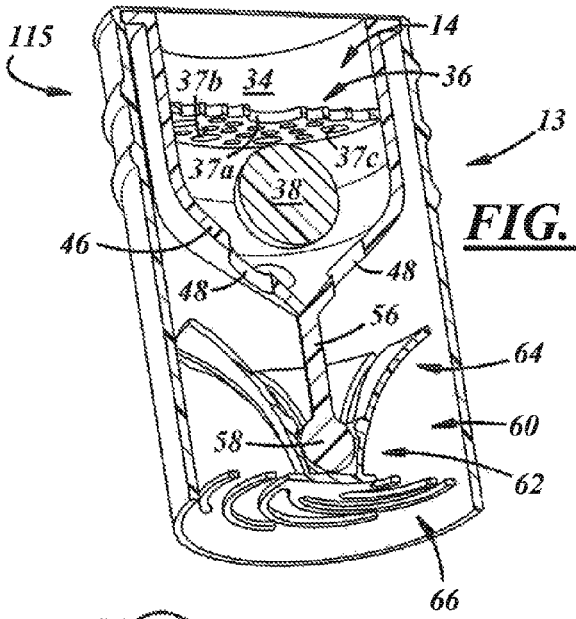
FIG. 4 is an enlarged, cross-sectional, perspective view of the closure and fitment of FIG. 2.

FIGS. 1 and 2 illustrate a product 10 in accordance with an illustrative embodiment of the disclosure as including a container 12 to hold a liquid product P, a closure 13 coupled to the container 12, and a dispensing fitment 14 (FIG. 2) coupled to the container 12 and covered by the closure 13. As such, the product 10 may be a package, but without the closure 13 the product 10 may include just the container 12 and fitment 14. The fitment 14 may render the container 12 non-refillable. In other words, the fitment 14 may prevent or at least impede efforts to refill the container 12, for example, with counterfeit liquid products. The terminology "non-refillable" is used interchangeably herein with the terms refill-resistant and anti-refill, and includes a characteristic of the fitment 14 which, by design intent, is not intended to be refilled without damaging the container 12 and/or fitment 14 or otherwise visibly compromising the structural and/or functional integrity of either or both. As will be described below, the fitment 14 also may facilitate evidencing of efforts to tamper with the product 10, for example, when someone attempts to refill the container 12.

With reference to FIG. 1, the container 12 can be a bottle, for example, a wine or spirits bottle or any other suitable type of bottle or container, and can be composed of plastic, or glass or any other suitable ceramic material(s). The container 12 may include a bottom or base 18, a body 16 including a sidewall 20 extending in a direction axially away from the base 18 along a central longitudinal axis A of the container 12. The container 12 also may include a shoulder 22 extending in a direction axially away from the sidewall 20, and a neck 24 extending in a direction axially away from the shoulder 22 and including a neck finish 26. As used herein, directional words such as top, bottom, upper, lower, radial, circumferential, lateral, longitudinal, transverse, vertical, horizontal, and the like are employed by way of description and not limitation.

With respect to FIG. 2, the neck finish 26 may include an open end or mouth 28 of the container 12, and one or more closure engagement elements 30, for example, helical threads, or any other suitable feature(s), for coupling to corresponding elements 29 of the closure 13. The container neck 24 may include an interior passage 32 and a corresponding interior surface 33 to receive the fitment 14 and to communicate liquid out of the container body 16 and through and out of the neck 24. The neck 26 also may include a detent 27 located axially between the shoulder 22 and the mouth 28 and, more particularly, axially between the shoulder 22 and the engagement element(s) 30. In the embodiment illustrated in FIG. 2, the detent 27 includes a portion of the neck 26 that is reduced in diameter in contrast to axially adjacent portion of the neck 26 but that is generally of the same wall thickness compared to those axially adjacent portions, to establish an hourglass shape in the neck 26. Accordingly, the illustrated detent 27 is hourglass-shaped. In another embodiment, the detent 27 may include a portion of the neck 26 that is increased in wall thickness to form a radially smaller portion of the neck 26. In other embodiments, the detent 27 may include a step in the wall of the neck 26, a separate component assembled into the neck 26, for example, a ring, or any other suitable component. The geometry of the container 12 of FIG. 1 is illustrative only, and any other suitable geometries may be used.

Figure 3:
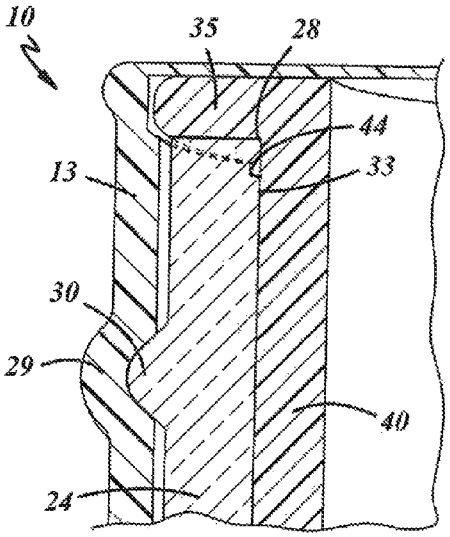
FIG. 3 is a further enlarged, fragmentary, cross-sectional view of the product illustrated in FIGS. 1 and 2, and illustrating a friction fit between the fitment and the container.

Still referring to FIG. 2, the fitment 14 may be received in the container neck 24, for example, within the neck finish 26, and further may include a dispensing portion with any suitable features to impede or prevent refilling of the container 12. For example, the fitment 14 may include a check valve. The check valve may include a valve retainer 34 positioned in the container neck 24, a plug 36 positioned in the container neck 24 and in the valve retainer 34, and a valve ball 38 positioned in the container neck 24 between the valve retainer 34 and the plug 36. The relationship between the fitment 14 and the container 12 may be such that an axial end of the fitment 14 extends axially from the mouth 28, and out, of the container 12. For example, as also shown in FIG. 3, the retainer 34 may include a transversely extending flange 35 that may axially engage a transversely extending surface or rim of the container, just radially outward of the mouth 28 of the container 12. As used herein, the term transverse may mean disposed at some non-zero angle with respect to the longitudinal axis A of the container 12 and along any direction intersecting the container 12 and may include but is not limited to a radial direction. The plug 36 may be composed of plastic, metal, glass or any other suitable ceramic, or any other suitable material, and the valve retainer 34 and valve ball 38 may be composed of plastic, metal, glass or any other suitable ceramic, or any other suitable material. In a preferred arrangement, the retainer 34, plug 36, and ball 38 are all composed of one or more ceramic materials for recyclability.

The valve retainer 34 includes an inboard wall 40 that may extend generally axially in the interior passage 32 of the container 12 and in contact with the container neck 24. The wall 40 may be of cylindrical shape or of any other suitable shape corresponding to the shape of the corresponding portion of the container neck 24. The wall 40 has a radially inner surface 42, and a radially outer surface 44 in contact with the neck interior surface 33. The valve retainer 34 further may include a valve ball seat 46 that may extend radially inwardly and axially from the inboard wall 40 and may include one or more apertures 48. The seat 46 may be conical. The valve retainer 34 may be friction or interference fit with respect to the container 12. For example, the retainer 34 may be press fit into the neck 24 of the container 12.

The plug 36 may include a plurality of apertures, which may include a central aperture 37*a*, smaller apertures 37*b*, and larger apertures 37*c*. The plug 36 may be a plate, as shown, with the apertures, or may be of any other suitable shape and configuration. The plug 36 may be coupled to the retainer 34 by interference fit (for example, snap fit or undercut), adhesive bond, ultrasonic bond, or non-removable threaded connection. The plug 36 allows fluid to flow through freely therethrough, yet provides a barrier to prevent the valve ball 38 from falling out. The valve ball 38 may be loosely trapped between the seat 46 and the plug 36. The apertures of the plug 36 establish a fluid path around the valve ball 38, and allow liquid to pass between the valve ball 38 and the plug 36 when the ball 38 contacts the plug 36.

The illustrative check valve permits flow of liquid out of the container body 16 but prevents or retards flow into the container body 16. For example, the valve ball 38 covers the valve seat aperture(s) 48 to prevent flow therethrough. But when the container 12 is tipped or inverted, liquid may flow through the aperture(s) 48 to displace the valve ball 38, and the liquid may flow between the ball 38 and the plug 36 and through the fitment 14. Non-refillable fitments are well known to those of ordinary skill in the art, and any suitable type of fitment may be used, whether a check valve type of fitment, an air trap type of fitment, or any other suitable type of refill-resistant fitment.

The fitment 14 also includes a detachable portion 60. The detachable portion 60 may be detachably coupled to a dispensing portion of the fitment 14, for example the retainer 34, in any suitable manner. For instance, the retainer 34 may include an extension 56 and a first coupling 58 on the extension 56. The extension 56 may extend axially from a central portion of the valve seat 46, and the first coupling 58 may have an outwardly spherical surface and may include a ball-like structure. In the illustrated embodiment, the detachable portion 60 is a component that is separate from the portion of the fitment 14 to which it is coupled.

The detachable portion 60 may include a second coupling 62 corresponding to the first coupling 58 of the retainer 34, a detent engagement element 64 that may extend axially and radially from the coupling 62, and a radially expandable element 66 that may extend radially from the coupling 62. The second coupling 62 may have an inwardly spherical surface and may include a socket-like structure to cooperate with the ball-like structure of the first coupling 58. Accordingly, the detachable portion 60 may be coupled to the retainer 34 with a ball-and-socket type of coupling arrangement.

The detent engagement element 64 may engage the container detent 27 and may include a plurality of circumferentially spaced leaves 63 that are resiliently displaceable in a radial direction and that are incurvately shaped with respect to the axis A and have detent engagement portions 65 engageable with the container detent 27. Those of ordinary skill in the art will recognize that the detent engagement element 64 need not include the leaves 63 and could include an uninterrupted, circumferentially continuous component composed of a suitably resilient material to facilitate assembly thereof to the container 12.

The radially expandable element 66 may include a plurality of arms 68 that are resiliently displaceable and radially compressed when disposed in the container neck 24, but that expand radially when the detachable portion 60 detaches and falls from the neck 24 into the container body 16. In the illustrated embodiment, the arms 68 are arcuate and, more specifically, are spiral-shaped. Accordingly, the radially expandable element 66 may be spiral shaped or pinwheel shaped. But in other embodiments, the arms 68 may be of any other suitable shape(s).

Figure 5:
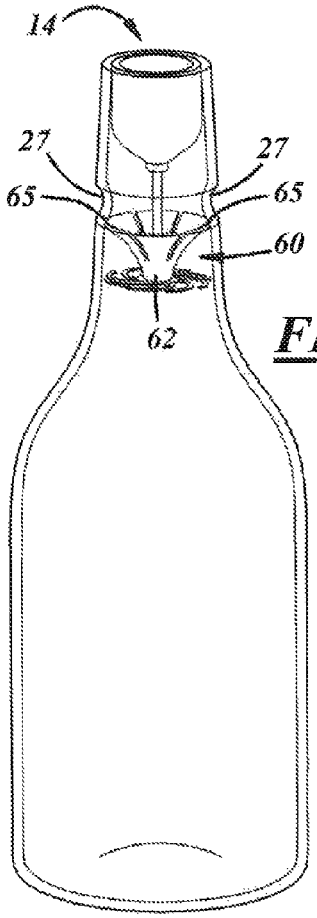
FIG. 5 is a perspective view of the container and fitment of FIG. 2, illustrating the fitment in a normal position.

With reference to FIG. 5, the detachable portion 60 is normally coupled to the rest of the fitment 14 in normal use of the product 10. The relationship between the detachable portion 60 and the container 12 is such that the detent engagement portions 65 are in contact with or in close proximity to the container detent 27. But if, as they are known to do, counterfeiters attempt to remove the fitment 14 from the container 12, then the detachable portion 60 will be displaced in an axial direction toward the mouth 28 of the container 12 and toward the detent 27 wherein the detent engagement portions 65 of the detachable portion 60 will engage or further engage the detent 27.

Figure 6:
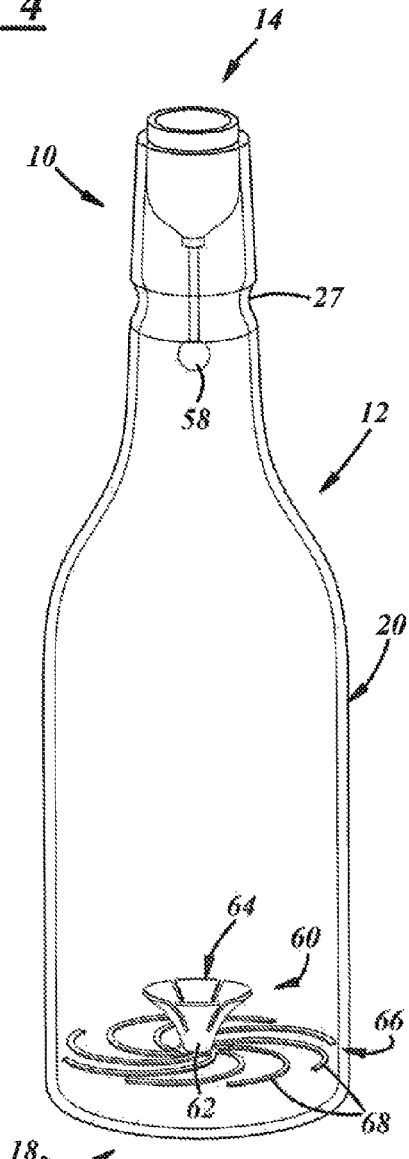
FIG. 6 is a perspective view of the container and fitment of FIG. 2, illustrating a dispensing portion of the fitment displaced partially out of the container and a detachable portion of the fitment separated from the dispensing portion and resting on a bottom of the container.

Accordingly, as illustrated in FIG. 6, continued movement of the fitment 14 in a direction axially away from the base 18 of the container 12 will result in decoupling of the first and second couplings 58, 62 such that the detachable portion 60 will become detached from the fitment 14 and fall from the container neck 24 into the container body 16, for example, to the bottom of the container 12. Also, the radially expandable element 66 will expand radially, such that the detachable portion 60 will resist or prevent removal back into and/or through the container neck 24. In fact, the arms 68 may expand into contact with the inside surfaces of the container 12 wherein the detachable portion 60 may remain in place at the bottom of the container 12.

Figure 7:
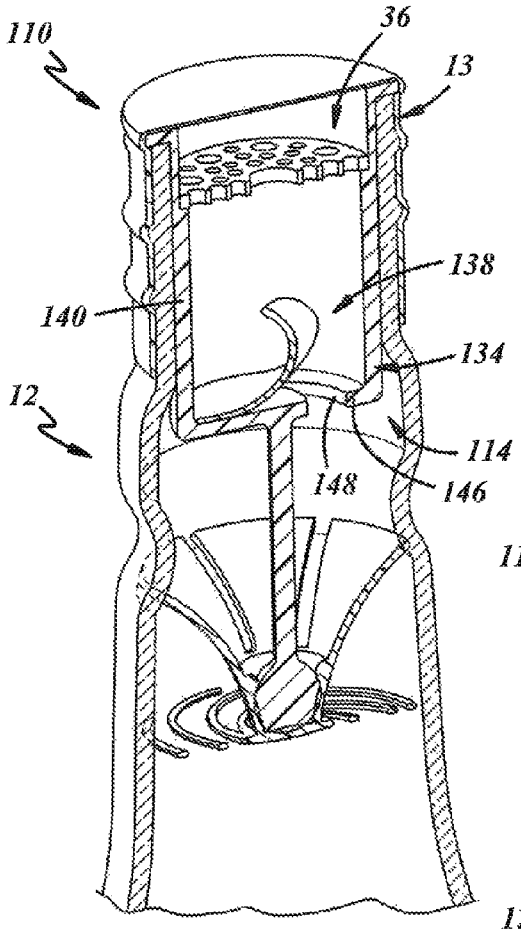
FIG. 7 is enlarged, fragmentary, cross-sectional view of a product in accordance with another illustrative embodiment of the present disclosure and including a container, a closure coupled to the container, and an anti-refill dispensing fitment.
Figure 8:
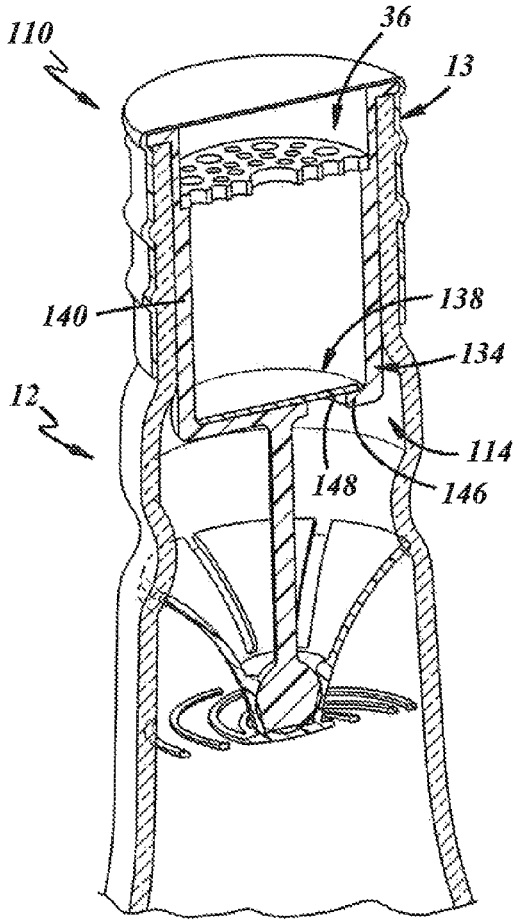
FIG. 8 is an enlarged, fragmentary, cross-sectional view of the product of FIG. 7, illustrating a valve flap in a seated position.

FIGS. 7 and 8 illustrate another illustrative embodiment of a product 110. This embodiment is similar in many respects to the embodiment of FIGS. 1 through 6 and like numerals between the embodiments generally designate like or corresponding elements throughout the several views of the drawing figures. Accordingly, the descriptions of the embodiments are incorporated into one another. Additionally, the description of the common subject matter generally may not be repeated here.

The product 110 includes the container 12, the closure 13 coupled to the container 12, and a dispensing fitment 114 coupled to the container 12 and covered by the closure 13. In this embodiment, the fitment 114 includes a flapper check valve arrangement. For example, the arrangement may include a valve retainer 134, the plug 36, and a valve flap 138 between the valve retainer 134 and the plug 36. The valve flap 138 may be composed of a polymeric material, for example, a thermoplastic or an elastomer, or may be composed of any other suitable material. The retainer 134 includes a valve flap seat 146 that may extend transversely from an inboard wall 140 and may include one or more apertures 148. As shown in FIG. 7, a portion of the valve flap 138 for covering the aperture 148 may be displaced by liquid flowing out of the container 12 through the fitment 114. As shown in FIG. 8, that portion of the valve flap 138 may cover the aperture 148 when liquid is not being dispensed out of the container 12 through the fitment 114. In other words, FIG. 8 illustrates the valve flap 138 seated over the aperture 148. A suitable portion of the valve flap 138 may be coupled to the retainer 134 by adhesive, staking, welding or melting, or in any other suitable manner.

Figure 9:
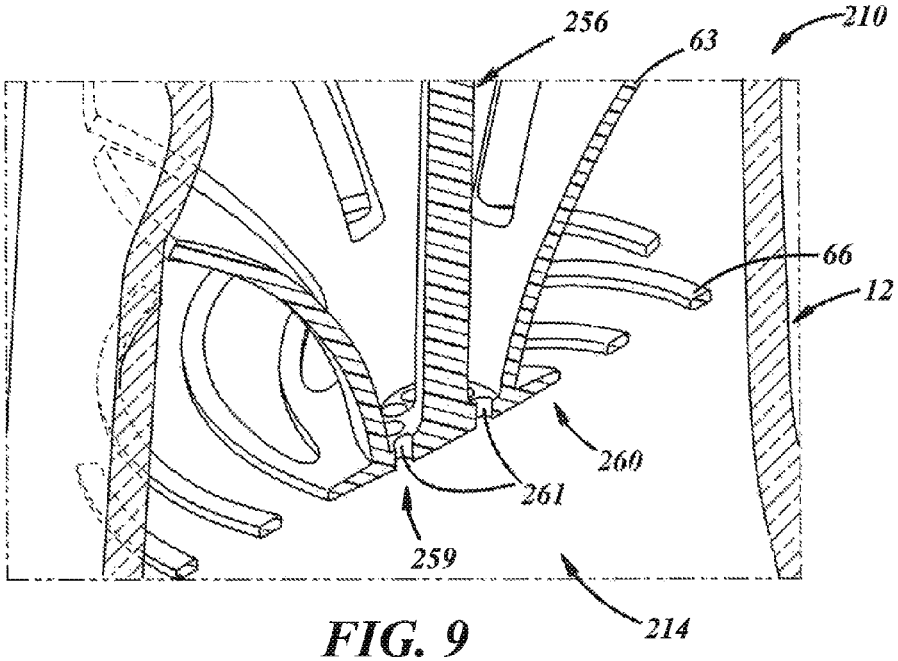
FIG. 9 is a fragmentary, perspective, cross-sectional view of a product in accordance with a further illustrative embodiment of the present disclosure and including a container and an anti-refill dispensing fitment carried in the container.
Figure 10:
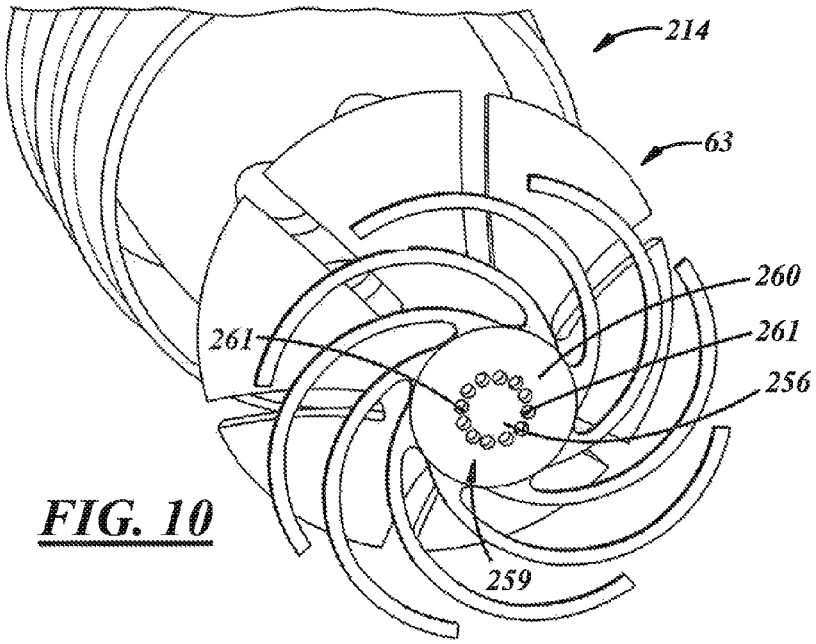
FIG. 10 is a fragmentary bottom perspective view of the fitment of FIG. 9.

FIGS. 9 and 10 illustrate another illustrative embodiment of a product 210. This embodiment is similar in many respects to the embodiment of FIGS. 1 through 8 and like numerals between the embodiments generally designate like or corresponding elements throughout the several views of the drawing figures. Accordingly, the descriptions of the embodiments are incorporated into one another. Additionally, the description of the common subject matter generally may not be repeated here.

Referring the FIG. 9, the product 210 includes the container 12, and a fitment 214 carried in the container 12. The fitment includes a retainer extension 256, a detachable portion 260, and a detachable coupling 259 between the extension 256 and the detachable portion 260. The detachable portion 260 includes the leaves 63 and the radially expandable element 66. The detachable coupling 259 may include a frangible integral connection between the extension 256 and the detachable portion 260. For example, as also shown in FIG. 10, the detachable coupling 259 may include perforations 261 between the extension 256 and the detachable portion 260 and corresponding webs or material between the perforations 261. The perforations 261 may be provided in a circular array, as illustrated in the figures. Movement of the fitment 214 out of the container 12 will result in fracture of the frangible material between the perforations 261, thereby decoupling the detachable portion 260 from the extension 256. The entire fitment 214, including but not limited to the retainer extension 256 and the detachable portion 260, may be manufactured as one-piece. For example, the fitment 214 may be injection molded to include the perforations 261, for instance, with corresponding pins in a mold. In another example, the fitment 214 may be injection molded without the perforations 261 and thereafter the fitment 214 may be laser or mechanically perforated to produce the perforations 261.

In production, a liquid product may be flowed into the container 12 in any suitable manner, and then the fitment 14, 114, 214 can be assembled to the container 12. For instance, the entire fitment 14, 114, 214 including the detachable portion 60 can be inserted into the neck 24 of the container 12. In one example, the radially expandable element and the detent engagement element are radially compressed so that the elements will fit in the container neck 24. The fitment 14, 114, 214 can be further inserted until the detent engagement element snaps past the container detent 27 and into engagement therewith, and the retainer is axially positioned as desired. Thereafter, the fitment 14, 114, 214 cannot be removed axially out of the container neck 24 without resulting in visible evidence of tampering or attempted removal of the fitment 14, 114, 214.

In a particular example, an assembly machine could combine all the appropriate components into a final fitment assembly 115 (FIG. 4), including the closure 13, for application to the container 12. Through a system of sorter bowls and orienting machines, each component may be aligned to a correct orientation and fed into a linear or rotary assembly platform. In either case, the components may be fed into tracks, which in turn feed an insertion station. Each insertion station may assemble the components in the correct order and orientation to complete the final fitment assembly. The radially expandable element 66 may be handled with a separate machine to orient the component and including a pre-staging station to pre-compress the expandable arms into a tooling sleeve prior to insertion into the closure 13. For example, this machine may include an apparatus to hold the top of the detachable element 66 and the expanding arms 68, and may spin the detachable element 66 into a conical tooling sleeve where the arms 68 would be brought together. As the detachable element 66 is further compressed as it is forced further into the conical tooling sleeve, the expandable arms 68 would be compressed to a diameter that could be made to be retained within the wall of the closure 13. As the detachable element 66 leaves the open end of the conical tooling sleeve, it would move directly into the closure 13 abutting the end of the conical tooling sleeve. Methods and systems to carry out such an assembly process are well understood to those of ordinary skill in the art.

There thus has been disclosed a container that is non-refillable and that fully satisfies all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. An anti-refill product that includes:

a container including a base, a body extending in a direction axially away from the base, a shoulder extending in a direction axially away from the body, and a neck extending in a direction axially away from the shoulder and including a neck finish and an interior surface, and a detent; and an anti-refill dispensing fitment positioned in the neck of the container, and including a detachable portion having a radially expandable element that is radially compressed when disposed in the container neck and a detent engagement element to engage the container detent, wherein, if the fitment is displaced in an axial direction away from the container base, then the detent engagement element engages the detent such that continued displacement of the fitment away from the base results in detachment of the detachable portion such that the detachable portion falls into the container body and the radially expandable element expands and thereby renders the product tamper-evident.

2. The product set forth in claim 1, wherein the anti-refill dispensing fitment includes a check valve including:

a valve retainer positioned in the neck of the container and having a radially inner surface, and a radially outer surface in contact with the interior surface of the container, wherein the detachable portion is coupled to the valve retainer, a plug positioned in the neck of the container and in contact with the inner surface of the retainer, and a valve ball positioned between the valve retainer and the plug.

3. The product set forth in claim 2, wherein the valve retainer includes a conical portion, an extension extending axially from the conical portion, and a first coupling on the extension, and wherein the detachable portion includes a second coupling coupled to the first coupling.

4. The product set forth in claim 3, wherein the first and second couplings include a ball-and-socket coupling arrangement.

5. The product set forth in claim 2, wherein the valve retainer includes a conical portion, an extension extending axially from the conical portion, and a frangible integral connection between the extension and the detachable portion.

6. The product set forth in claim 5, wherein frangible integral connection includes perforations between the extension and the detachable portion.

7. The product set forth in claim 1, wherein the detent engagement element includes a plurality of circumferentially spaced leaves that are resiliently displaceable in a radial direction and that are incurvately shaped.

8. The product set forth in claim 1, wherein the radially expandable element includes a plurality of arcuately shaped arms.

9. An anti-refill product that includes:

a container including a base, a body extending in a direction axially away from the base, a shoulder extending in a direction axially away from the body, and a neck extending in a direction axially away from the shoulder and including a neck finish and an interior surface, and a detent; and an anti-refill dispensing fitment positioned in the neck of the container, and including a detachable portion having a radially expandable element and a detent engagement element to engage the container detent, wherein, if the fitment is displaced in an axial direction away from the container base, then the detent engagement element engages the detent such that continued displacement of the fitment away from the base results in detachment of the detachable portion such that the detachable portion falls into the container body and thereby renders the product tamper-evident, wherein the arms are spiral shaped.

10. A method of producing a product that includes:

(a) flowing liquid into a container including a base, a body extending in a direction axially away from the base, a shoulder extending in a direction axially away from the body, and a neck extending in a direction axially away from the shoulder and including a neck finish, an interior surface, and a detent; and (b) assembling an anti-refill fitment into the neck of the container so that a detent engagement element of a detachable portion of the fitment snaps past and engages the container detent and so that a radially expandable element of the detachable portion of the fitment is located within the container neck and is radially compressed when disposed in the container neck, whereafter, if the fitment is displaced in an axial direction away from the container base, then the detent engagement element engages the detent such that continued displacement of the fitment away from the base results in detachment of the detachable portion such that the detachable portion falls into the container body and the radially expandable element expands and thereby renders the product tamper-evident.

11. The method of claim 10, wherein the assembling step (b) includes pre-compressing the radially expandable element prior to insertion into the container.

12. A product produced by the method of claim 10.

13. A package that includes:

a bottle having a base, a body extending in a direction axially away from the base, a shoulder extending in a direction axially away from the body, and a neck extending in a direction axially away from the shoulder and including a neck finish with an open end, an interior surface, and a detent, a closure coupled to said open end of said neck, a fitment configured to be received into said open end of said neck, and a detachable portion detachably coupled to said fitment and having a radially expandable element and a detent engagement element to engage said detent in said neck and said radially expandable element being radially compressed when disposed in the container neck, wherein, if the fitment is displaced in an axial direction away from the container base, then the detent engagement element engages the detent such that continued displacement of the fitment away from the base results in detachment of the detachable portion such that the detachable portion falls into the container body and the radially expandable element expands and thereby renders the package tamper-evident.

14. The package set forth in claim 13 wherein said radially expandable element includes arcuate arms that are compressed when disposed in said neck but expand radially when said element falls from said neck into said body.

15. A tamper-evident component for an anti-refill dispensing fitment to render a container tamper-evident, the component including:

a coupling;

a radially expandable element extending radially from the coupling, and including a plurality of arcuately shaped arms; and a container detent engagement element extending axially and radially from the coupling, and including a plurality of circumferentially spaced leaves that are resiliently displaceable in a radial direction.

16. The component set forth in claim 15, wherein the leaves are incurvately shaped.

17. An assembly including an anti-refill dispensing fitment including:

a tamper-evident component as a detachable portion of the fitment to render a container tamper-evident and including, a coupling, a radially expandable element extending radially from the coupling, and a container detent engagement element extending axially and radially from the coupling;

a dispensing portion of the fitment coupled to the detachable portion and including an extension and a coupling on the extension for coupling to the detachable portion coupling; and a closure in which the radially expandable element is contained.

* * * * *